US006630774B2

(12) United States Patent
Avnery

(10) Patent No.: US 6,630,774 B2
(45) Date of Patent: Oct. 7, 2003

(54) ELECTRON BEAM EMITTER

(75) Inventor: Tzvi Avnery, Winchester, MA (US)

(73) Assignee: Advanced Electron Beams, Inc., Wilmington, DE (US)

( * ) Notice: Subject to any disclaimer, the term of this patent is extended or adjusted under 35 U.S.C. 154(b) by 36 days.

(21) Appl. No.: 09/813,928

(22) Filed: Mar. 21, 2001

(65) Prior Publication Data

US 2002/0135285 A1 Sep. 26, 2002

(51) Int. Cl.[7] ..... H01K 1/02; H01K 1/14; H01J 1/16

(52) U.S. Cl. ..... 313/341; 313/349; 313/271; 313/273; 313/361.1

(58) Field of Search ..... 313/341, 271, 313/273, 359.1, 360.1, 361.1, 362.1, 363.1

(56) References Cited

U.S. PATENT DOCUMENTS

| | | | | | |
|---|---|---|---|---|---|
| 3,610,993 | A | | 10/1971 | Randels | 313/89 |
| 3,749,967 | A | | 7/1973 | Douglas-Hamilton et al. | 315/85 |
| 3,863,163 | A | | 1/1975 | Farrell et al. | 328/233 |
| 3,956,712 | A | | 5/1976 | Hant | 331/94.5 |
| 4,061,944 | A | | 12/1977 | Gay | 313/420 |
| 4,079,328 | A | | 3/1978 | Cleland et al. | 328/233 |
| 4,473,771 | A | * | 9/1984 | Lhotsky et al. | 313/336 |
| 4,499,405 | A | | 2/1985 | Loda | 315/13.1 |
| 4,584,468 | A | | 4/1986 | van de Wiel | 250/213 |
| 4,608,513 | A | * | 8/1986 | Thompson et al. | 313/359.1 |
| 4,760,262 | A | * | 7/1988 | Sampayan et al. | 250/423 |
| 4,760,306 | A | * | 7/1988 | Leung et al. | 313/341 |
| 4,795,940 | A | * | 1/1989 | Leung et al. | 313/346 |
| 4,891,525 | A | * | 1/1990 | Frisa et al. | 250/423 |
| 5,126,633 | A | | 6/1992 | Avnery et al. | 315/14 |
| 5,254,911 | A | | 10/1993 | Avnery et al. | 315/366 |
| 5,414,267 | A | | 5/1995 | Wakalopulos | 250/492.3 |
| 5,432,876 | A | * | 7/1995 | Appeldorn et al. | 385/31 |
| 5,483,074 | A | | 1/1996 | True | 250/423 |
| 5,631,471 | A | | 5/1997 | Anderl et al. | 250/492.3 |
| 5,659,643 | A | * | 8/1997 | Appeldorn et al. | 385/31 |
| 5,845,038 | A | * | 12/1998 | Lundin et al. | 385/901 |
| 5,962,995 | A | | 10/1999 | Avnery | 315/506 |
| 6,084,241 | A | * | 7/2000 | Sitter | 250/492.21 |
| 6,259,193 | B1 | * | 7/2001 | Lipkin et al. | 313/341 |
| 6,367,941 | B2 | * | 4/2002 | Lea et al. | 362/31 |
| 6,404,115 | B1 | * | 6/2002 | Sanderson | 313/359.1 |

FOREIGN PATENT DOCUMENTS

| | | |
|---|---|---|
| DE | 707254 | 6/1941 |
| GB | 888847 | 7/1958 |
| JP | 59111223 | 6/1984 |
| JP | 08171848 | 7/1996 |
| JP | 2000011854 | 1/2000 |
| WO | WO 00/34958 | 6/2000 |
| WO | WO 01/04924 A1 | 1/2001 |

* cited by examiner

*Primary Examiner*—David Martin
*Assistant Examiner*—Dameon E. Levi
(74) *Attorney, Agent, or Firm*—Hamilton, Brook, Smith & Reynolds, PC

(57) ABSTRACT

A filament for generating electrons for an electron beam emitter where the filament has a cross section and a length. The cross section of the filament is varied along the length for producing a desired electron generation profile.

19 Claims, 4 Drawing Sheets

ELECTRON BEAM EMITTER

BACKGROUND

A typical electron beam emitter includes a vacuum chamber with an electron generator positioned therein for generating electrons. The electrons are accelerated out from the vacuum chamber through an exit window in an electron beam. Typically, the exit window is formed from a metallic foil. The metallic foil of the exit window is commonly formed from a high strength material such as titanium in order to withstand the pressure differential between the interior and exterior of the vacuum chamber.

A common use of electron beam emitters is to irradiate materials such as inks and adhesives with an electron beam for curing purposes. Other common uses include the treatment of waste water or sewage, or the sterilization of food or beverage packaging. Some applications require particular electron beam intensity profiles where the intensity varies laterally. One common method for producing electron beams with a varied intensity profile is to laterally vary the electron permeability of either the electron generator grid or the exit window. Another method is to design the emitter to have particular electrical optics for producing the desired intensity profile. Typically, such emitters are custom made to suit the desired use.

SUMMARY

The present invention is directed to a filament for generating electrons for an electron beam emitter in which the configuration of the filament is varied for producing a desired electron generation profile. Consequently, a standardized electron beam emitter may be used for a variety of applications requiring different intensity profiles with the configuration of the filaments within the emitter being selected to provide the desired electron beam intensity profile.

In preferred embodiments, the filament has a cross section and a length. The cross section of the filament is varied along the length for producing a desired electron generation profile. Typically, the filament has varying cross sectional areas along the length. In situations where the cross section of the filament is round, the filament also has varying diameters along the length. Consequently, the filament can have at least one major cross sectional area (or major diameter) and at least one minor cross sectional area (or minor diameter). The major cross sectional area (or major diameter) is greater than the minor cross sectional area (or minor diameter). The at least one minor cross sectional area (or minor diameter) increases temperature and electron generation at the at least one minor cross sectional area (or minor diameter). The filament can have multiple minor cross sectional areas or minor diameters which are spaced apart from each other at selected intervals.

In one embodiment, the at least one minor cross sectional area or minor diameter is positioned at or near one end of the filament to compensate for voltage drop across the length of the filament so that the filament is capable of uniformly generating electrons along the length of the filament. In another embodiment, the at least one minor cross sectional area or minor diameter is positioned at or near opposite ends of the filament for generating a greater amount of electrons at or near the ends.

Typically, the filament is part of an electron generator which is positioned within a vacuum chamber of an electron beam emitter. The vacuum chamber has an exit window through which the electrons generated by the filament exit the vacuum chamber in an electron beam.

In the present invention, by varying the cross sectional areas or diameters of the electron generating filament, a variety of desired electron generation profiles can be selected to suit specific applications. Since no significant changes need to be made to the components of an electron beam emitter including such a filament, and fabrication of the filament is relatively inexpensive, the cost of an electron beam emitter employing the filament is not greatly increased.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Figure 1:
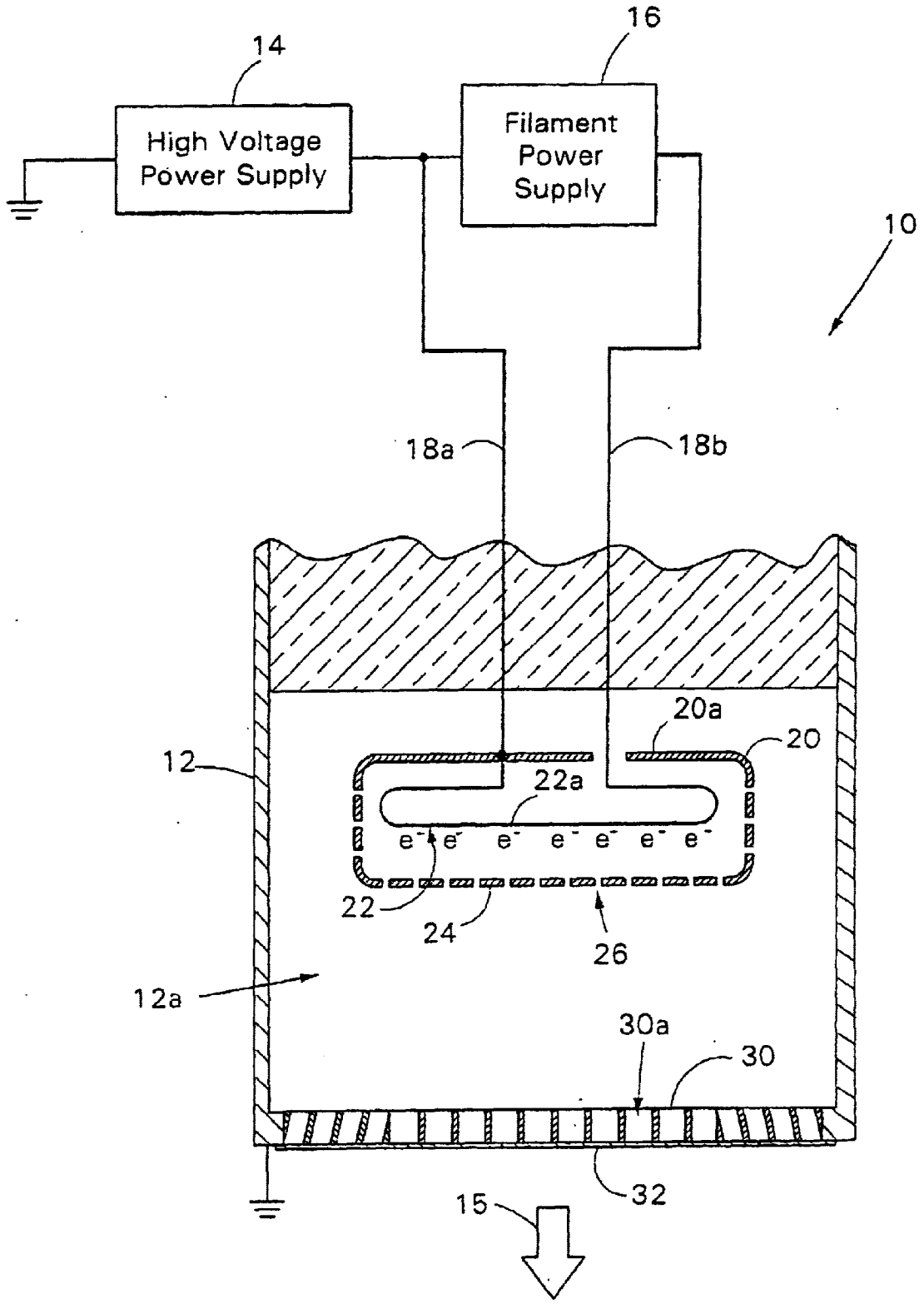
FIG. 1 is a schematic sectional drawing of an electron beam emitter of the present invention.

Referring to FIG. 1, electron beam emitter 10 includes a vacuum chamber 12 having an exit window 32 at one end thereof. An electron generator 20 is positioned within the interior 12*a* of vacuum chamber 12 for generating electrons $e^-$ which exit the vacuum chamber 12 through exit window 32 in an electron beam 15. In particular, the electrons $e^-$ are generated by an electron generating filament assembly 22 positioned within the housing 20*a* of the electron generator 20 and having one or more electron generating filaments 22*a*. The bottom 24 of housing 20*a* includes series of grid-like openings 26 which allow the electrons $e^-$ to pass therethrough. The cross section of each filament 22*a* is varied (FIG. 2) to produce a desired electron generating profile. Specifically, each filament 22*a* has at least one larger or major cross sectional area portion 34 and at least one smaller or minor cross sectional area portion 36, wherein the cross sectional area of portion 34 is greater than that of portion 36. The housing 20*a* and filament assembly 22 are electrically connected to high voltage power supply 14 and filament power supply 16, respectively, by lines 18*a* and 18*b*. The exit window 32 is electrically grounded to impose a high voltage potential between housing 20*a* and exit window 32, which accelerates the electrons $e^-$ generated by electron generator 20 through exit window 32. The exit window 32 includes a structural metallic foil 32*a* (FIG. 10) that is sufficiently thin to allow the passage of electrons $e^-$ therethrough. The exit window 32 is supported by a rigid support plate 30 that has holes 30*a* therethrough for the passage of electrons $e^-$. The exit window 32 includes an exterior coating or layer 32*b* of corrosion resistant high thermal conductive material for resisting corrosion and increasing the conductivity of exit window 32.

In use, the filaments 22*a* of electron generator 20 are heated up to about 4200° F. by electrical power from filament power supply 16 (AC or DC) which causes free electrons $e^-$ to form on the filaments 22*a*. The portions 36 of filaments 22*a* with smaller cross sectional areas or diameters typically have a higher temperature than the portions 34 that have a larger cross sectional area or diameter. The elevated temperature of portions 36 causes increased generation of electrons at portions 36 in comparison to portions 34. The high voltage potential imposed between filament housing 20*a* and exit window 32 by high voltage power supply 14 causes the free electrons $e^-$ on filaments 22*a* to accelerate from the filaments 22*a* out through the openings 26 in housing 20*a*, through the openings 30*a* in support plate 30, and through the exit window 32 in an electron beam 15. The intensity profile of the electron beam 15 moving laterally across the electron beam 15 is determined by the selection of the size, placement and length of portions 34/36 of filaments 22*a*. Consequently, different locations of electron beam 15 can be selected to have higher electron intensity. Alternatively, the configuration of portions 34/36 of filaments 22*a* can be selected to obtain an electron beam 15 of uniform intensity if the design of the electron beam emitter 10 normally has an electron beam 15 of nonuniform intensity.

The corrosion resistant high thermal conductive coating 32*b* on the exterior side of exit window 32 has a thermal conductivity that is much higher than that of the structural metallic foil 32*a* of exit window 32. The coating 32*b* is sufficiently thin so as not to substantially impeded the passage of electrons e therethrough but thick enough to provide exit window 32 with a thermal conductivity much greater than that of foil 32*a*. When the structural foil 32*a* of an exit window is relatively thin (for example, 6 to 12 microns thick), the electron beam 15 can burn a hole through the exit window if insufficient amounts of heat is drawn away from the exit window. Depending upon the material of foil 32*a* and coating 32*b*, the addition of coating 32*b* can provide exit window 32 with a thermal conductivity that is increased by a factor ranging from about 2 to 8 over that provided by foil 32*a*, and therefore draw much more heat away than if coating 32*b* was not present. This allows the use of exit windows 32 that are thinner than would normally be possible for a given operating power without burning holes therethrough. An advantage of a thinner exit window 32 is that it allows more electrons $e^-$ to pass therethrough, thereby resulting in a higher intensity electron beam 15 than conventionally obtainable. Conversely, a thinner exit window 32 requires less power for obtaining an electron beam 15 of a particular intensity and is therefore more efficient. By forming the conductive coating 32*b* out of corrosion resistant material, the exterior surface of the exit window 32 is also made to be corrosion resistant and is suitable for use in corrosive environments.

A more detailed description of the present invention now follows. FIG. 1 generally depicts electron beam emitter 10. The exact design of electron beam emitter 10 may vary depending upon the application at hand. Typically, electron beam emitter 10 is similar to those described in U.S. patent application Ser. Nos. 09/349,592 filed Jul. 9, 1999 and Ser. No. 09/209,024 filed Dec. 10, 1998, the contents of which are incorporated herein by reference in their entirety. If desired, electron beam emitter 10 may have side openings on the filament housing as shown in FIG. 1 to flatten the high voltage electric field lines between the filaments 22*a* and the exit window 32 so that the electrons exit the filament housing 20*a* in a generally dispersed manner. In addition, support plate 30 may include angled openings 30*a* near the edges to allow electrons to pass through exit window at the edges at an outwardly directed angle, thereby allowing electrons of electron beam 15 to extend laterally beyond the sides of vacuum chamber 12. This allows multiple electron beam emitters 10 to be stacked side by side to provide wide continuous electron beam coverage.

Figure 2:
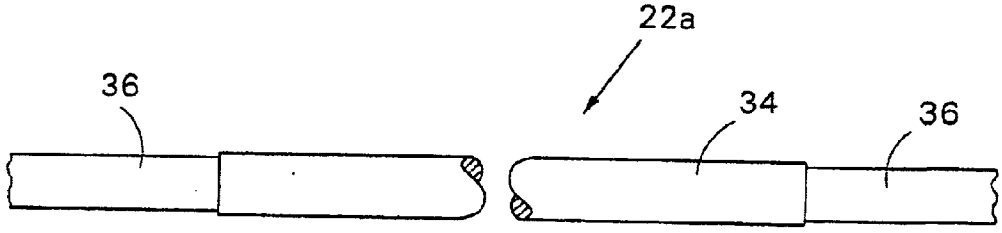
FIG. 2 is a side view of a portion of the electron generating filament.
Figure 3:
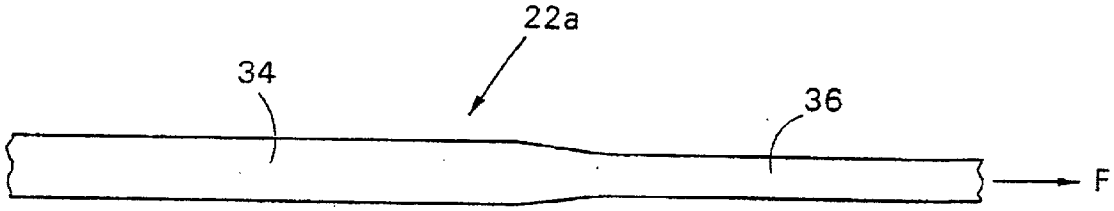
FIG. 3 is a side view of a portion of the electron generating filament depicting one method of forming the filament.

Referring to FIG. 2, filament 22*a* typically has a round cross section and is formed of tungsten. As a result, the major cross sectional area portion 34 is also a major diameter portion and the minor cross sectional area portion 36 is also a minor diameter portion. Usually, the major diameter portion 34 has a diameter that is in the range of 0.010 to 0.020 inches. The minor diameter portion 36 is typically sized to provide only 1° F. to 2° F. increase in temperature because such a small increase in temperature can result in a 10% to 20% increase in the emission of electrons $e^-$. The diameter of portion 36 required to provide a 1° F. to 2° F. increase in temperature relative to portion 36 is about 1 to 5 microns smaller than portion 34. The removal of such a small amount of material from portions 36 can be performed by chemical etching such as with hydrogen peroxide, electrochemical etching, stretching of filament 22*a* as depicted in FIG. 3, grinding, EDM machining, the formation and removal of an oxide layer, etc. One method of forming the oxide layer is to pass a current through filament 22*a* while filament 22*a* is exposed to air.

In one embodiment, filament 22*a* is formed with minor cross sectional area or diameter portions 36 at or near the ends (FIG. 2) so that greater amounts of electrons are generated at or near the ends. This allows electrons generated at the ends of filament 22*a* to be angled outwardly in an outwardly spreading beam 15 without too great a drop in electron density in the lateral direction. The widening electron beam allows multiple electron beam emitters to be laterally stacked with overlapping electron beams to provide uninterrupted wide electron beam coverage. In some applications, it may also be desirable merely to have a higher electron intensity at the ends or edges of the beam. In another embodiment where there is a voltage drop across the filament 22*a*, a minor cross sectional area or diameter portion 36 is positioned at the far or distal end of filament 22*a* to compensate for the voltage drop resulting in an uniform temperature and electron emission distribution across the length of filament 22*a*. In other embodiments, the number and positioning of portions 34 and 36 can be selected to suit the application at hand.

Figure 4:
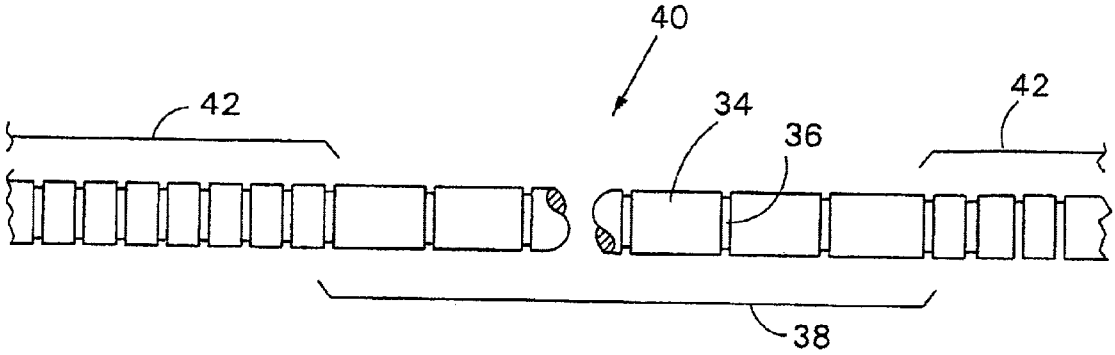
FIG. 4 is a side view of a portion of another embodiment of the electron generating filament.

Referring to FIG. 4, filament 40 may be employed within electron beam emitter 10 instead of filament 22*a*. Filament 40 includes a series of major cross sectional area or diameter portions 34 and minor cross sectional area or diameter portions 36. The minor diameter portions 36 are formed as narrow grooves or rings which are spaced apart from each other at selected intervals. In the region 38, portions 36 are spaced further apart from each other than in regions 42. As a result, the overall temperature and electron emission in regions 42 is greater than in region 38. By selecting the width and diameter of the minor diameter 36 as well as the length of the intervals therebetween, the desired electron generation profile of filament 40 can be selected.

Figure 5:
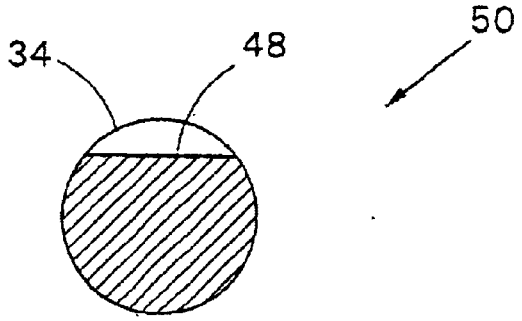
FIG. 5 is a cross sectional view of still another embodiment of the electron generating filament.
Figure 6:
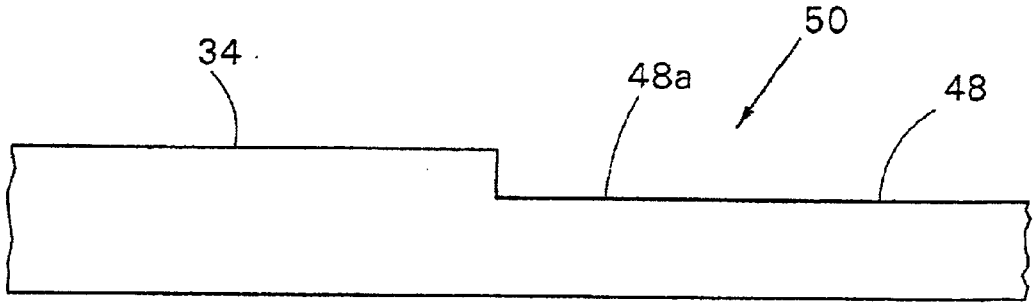
FIG. 6 is a side view of a portion of the electron generating filament depicted in FIG. 5.

Referring to FIGS. 5 and 6, filament 50 is still another filament which can be employed with electron beam emitter 10. Filament 50 has at least one major cross sectional area or diameter 34 and at least one continuous minor cross sectional area 48 formed by the removal of a portion of the filament material on one side of the filament 50. FIGS. 5 and 6 depict the formation of minor cross sectional area 48 by making a flattened portion 48*a* on filament 50. The flattened portion 48*a* can be formed by any of the methods previously mentioned. It is understood that the flattened portion 48*a* can alternatively be replaced by other suitable shapes formed by the removal of material such as a curved surface, or at least two angled surfaces.

Figure 7:
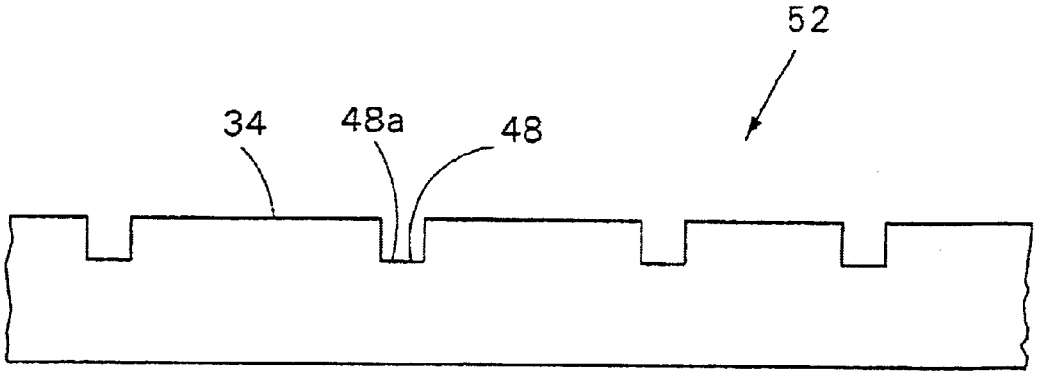
FIG. 7 is a side view of a portion of yet another embodiment of the electron generating filament.

Referring to FIG. 7, filament 52 is yet another filament which can be employed within electron beam emitter 10. Filament 52 differs from filament 50 in that filament 52 includes at least two narrow minor cross sectional areas 48 which are spaced apart from each other at selected intervals in a manner similar to the grooves or rings of filament 40 (FIG. 4) for obtaining desired electron generation profiles. The narrow minor cross sectional areas 48 of filament 52 can be notches as shown in FIG. 7 or may be slight indentations, depending upon the depth. In addition, the notches can include curved angled edges or surfaces.

Figure 8:
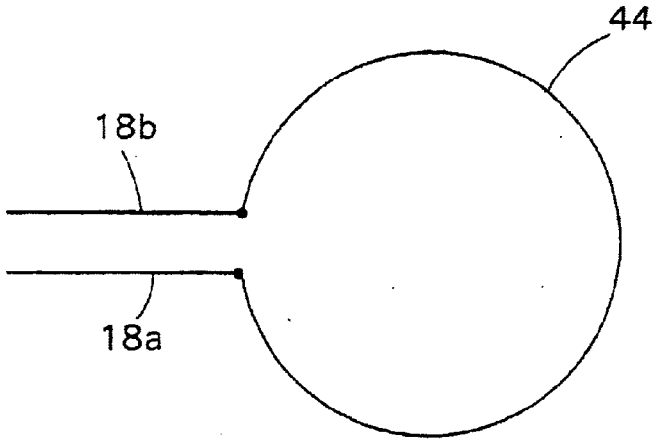
FIG. 8 is a top view of another electron generating filament.

Referring to FIG. 8, filament 44 is another filament which can be employed within electron beam emitter 10. Instead of being elongated in a straight line as with filament 22*a*, the length of filament 44 is formed in a generally circular shape. Filament 44 can include any of the major and minor cross sectional areas 34, 36 and 48 depicted in FIGS. 2–7 and arranged as desired. Filament 44 is useful in applications such as sterilizing the side walls of a can.

Figure 9:
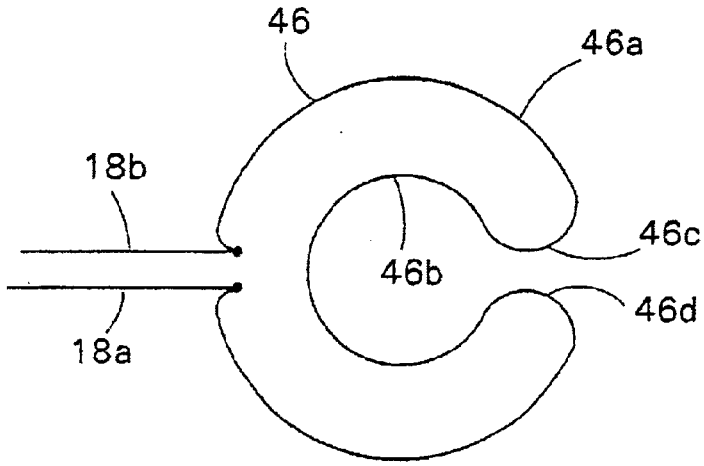
FIG. 9 is a top view of still another electron generating filament.

Referring to FIG. 9, filament 46 is still another filament which can be employed within electron beam emitter 10. Filament 46 includes two substantially circular portions 46*a* and 46*b* which are connected together by legs 46*c* and are concentric with each other. Filament 46 can also include any of the major and minor cross sectional areas 34, 36 and 48 depicted in FIGS. 2–7.

Figure 10:
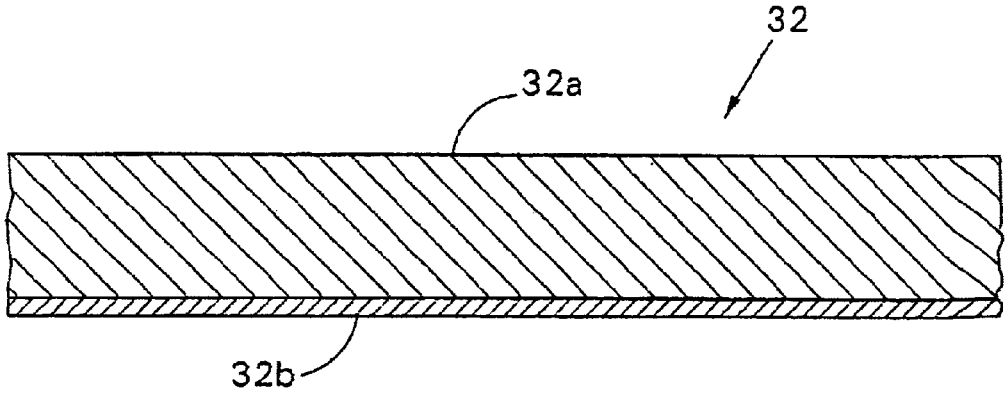
FIG. 10 is a cross sectional view of a portion of the exit window.

Referring to FIG. 10, the structural metallic foil 32*a* of exit window 32 is typically formed of titanium, aluminum, or beryllium foil. The corrosion resistant high thermal conductive coating or layer 32*b* has a thickness that does not substantially impede the transmission of electrons $e^-$ therethrough. Titanium foil that is 6 to 12 microns thick is usually preferred for foil 32*a* for strength but has low thermal conductivity. The coating of corrosion resistant high thermal conductive material 32*b* is preferably a layer of diamond, 0.25 to 2 microns thick, which is grown by vapor deposition on the exterior surface of the metallic foil 32*a* in a vacuum at high temperature. Layer 32*b* is commonly about 4% to 8% the thickness of foil 32*a*. The layer 32*b* provides exit window 32 with a greatly increased thermal conductivity over that provided only by foil 32*a*. As a result, more heat can be drawn from exit window 32, thereby allowing higher electron beam intensities to pass through exit window 32 without burning a hole therethrough than would normally be possible for a foil 32*a* of a given thickness. For example, titanium typically has a thermal conductivity of 11.4 W/m·k. The thin layer of diamond 32*b*, which has a thermal conductivity of 500–1000 W/m·k, can increase the thermal conductivity of the exit window 32 by a factor of 8 over that provided by foil 32*a*. Diamond also has a relatively low density (0.144 lb./in.$^3$) which is preferable for allowing the passage of electrons $e^-$ therethrough. As a result, a foil 32*a* 6 microns thick which would normally be capable of withstanding power of only 4 kW, is capable of withstanding power of 10 kW to 20 kW with layer 32*b*. In addition, the diamond layer 32*b* on the exterior surface of the metallic foil 32*a* is chemically inert and provides corrosion resistance for exit window 32. Corrosion resistance is desirable because sometimes the exit window 32 is exposed to environments including corrosive chemical agents. One such corrosive agent is hydrogen peroxide. The corrosion resistant high thermal conductive layer 32*b* protects the metal foil 32*a* from corrosion, thereby prolonging the life of the exit window 32.

Although diamond is preferred in regard to performance, the coating or layer 32*b* can be formed of other suitable corrosion resistant materials having high thermal conductivity such as gold. Gold has a thermal conductivity of 317.9 W/m·k. The use of gold for layer 32*b* can increase the conductivity over that provided by the titanium foil 32*a* by a factor of about 2. Typically, gold would not be considered desirable for layer 32*b* because gold is such a heavy or dense material (0.698 lb./in$^3$) which tends to impede the transmission of electrons $e^-$ therethrough. However, when very thin layers of gold are employed, 0.1 to 1 microns, impedance of the electrons $e^-$ is kept to a minimum. When forming the layer of material 32*b* from gold, the layer 32*b* is typically formed by vapor deposition but, alternatively, can be formed by other suitable methods such as electroplating, etc.

In addition to gold, layer 32*b* may be formed from other materials from group 1*b* of the periodic table such as silver and copper. Silver and copper have thermal conductivities of 428 W/m·k and 398 W/m·k, and densities of 0.379 lb./in.$^3$ and 0.324 lb./in.$^3$, respectively, but are not as resistant to corrosion as gold. Typically, materials having thermal conductivities above 300 W/m·k are preferred for layer 32*b*. Such materials tend to have densities above 0.1 lb./in.$^3$, with silver and copper being above 0.3 lb./in.$^3$ and gold being above 0.6 lb./in.$^3$. Although the corrosion resistant highly conductive layer of material 32*b* is preferably located on the exterior side of exit window for corrosion resistance, alternatively, layer 32*b* can be located on the interior side, or a layer 32*b* can be on both sides. Furthermore, the layer 32*b* can be formed of more than one layer of material. Such a configuration can include inner layers of less corrosion resistant materials, for example, aluminum (thermal conductivity of 247 W/m·k and density of 0.0975 lb./in.$^3$), and an outer layer of diamond or gold. The inner layers can also be formed of silver or copper. Also, although foil 32*a* is preferably metallic, foil 32*a* can also be formed from non-metallic materials.

While this invention has been particularly shown and described with references to preferred embodiments thereof, it will be understood by those skilled in the art that various changes in form and details may be made therein without departing from the scope of the invention encompassed by the appended claims.

For example, although electron beam emitter is depicted in a particular configuration and orientation in FIG. 1, it is understood that the configuration and orientation can be varied depending upon the application at hand. In addition, the various methods of forming the filaments can be employed for forming a single filament. Furthermore, although the thicknesses of the foil 32*a* and conductive layer 32*b* of exit window 32 have been described to be constant, alternatively, such thicknesses may be varied across the exit window 32 to produce desired electron impedance and thermal conductivity profiles.

What is claimed is:

1. A filament for generating electrons for an electron beam emitter, the filament having a generally round cross section and a length, the cross section of the filament being varied along the length for producing a desired electron generation profile along the length, the filament having a major diameter of about 0.020 inches or less.

2. The filament of claim 1 in which the filament has varying cross sectional areas along the length.

3. The filament of claim 2 in which the filament has at least one major cross sectional area and at least one minor cross sectional area, the major cross sectional area being greater than the minor cross sectional area, the at least one minor cross sectional area for causing increased temperature and electron generation at the at least one minor cross sectional area.

4. The filament of claim 3 in which the filament has multiple minor cross sectional areas, the minor cross sectional areas being spaced apart from each other at selected intervals.

5. The filament of claim 3 in which the at least one minor cross sectional area is positioned at one end of the filament to compensate for voltage drop across the length of the filament so that the filament is capable of uniformly generating electrons along the length of the filament.

6. The filament of claim 3 in which the at least one minor cross sectional area is positioned at opposite ends of the filament for generating a greater amount of electrons at the ends.

7. The filament of claim 2 in which the filament has varying diameters along the length.

8. The filament of claim 7 in which the filament has at least one major diameter and at least one minor diameter, the major diameter being greater than the minor diameter, the at least one minor diameter for causing increased temperature and electron generation at the at least one minor diameter.

9. The filament of claim 8 in which the filament has multiple minor diameters, the minor diameters being spaced apart from each other at selected intervals.

10. The filament of claim 8 in which the at least one minor diameter is positioned at one end of the filament to compensate for voltage drop across the length of the filament so that the filament is capable of uniformly generating electrons along the length of the filament.

11. The filament of claim 8 in which the at least one minor diameter is positioned at opposite ends of the filament for generating a greater amount of electrons at the ends.

12. A filament for generating electrons for an electron beam emitter, the filament having a generally round cross section and a length, the filament having a major diameter of about 0.020 inches or less, the filament also having varying diameters along the length for producing a desired electron generation profile along the length.

13. The filament of claim 12, in which at least one portion of the cross section is smaller and provides increased temperature.

14. An electron beam emitter comprising:

a vacuum chamber;

an electron generator positioned within the vacuum chamber for generating electrons, the electron generator including an electron generating filament having a generally round cross section and a length, the cross section of the filament being varied along the length for producing a desired electron generation profile along the length; and an exit window on the vacuum chamber through which the electrons exit the vacuum chamber in an electron beam, the filament having a major diameter of about 0.020 inches or less.

15. The emitter of claim 14 in which the filament has varying cross sectional areas along the length.

16. The emitter of claim 15 in which the filament has varying diameters along the length.

17. The filament of claim 14, in which at least one portion of the cross section is smaller and provides increased temperature.

18. A filament for generating electrons for an electron beam emitter, the filament having a round cross section and a length, the filament also having varying cross sections along the length for producing a desired electron generation profile along the length, the filament having a major diameter of about 0.020 inches or less.

19. The filament of claim 18, in which at least one portion of the cross section is smaller and provides increased temperature.

* * * * *